US011019898B2

(12) United States Patent
Ripple

(10) Patent No.: US 11,019,898 B2
(45) Date of Patent: Jun. 1, 2021

(54) PICNIC FOOD TRANSPORTATION ASSEMBLY

(71) Applicant: David Ripple, Aberdeen, NJ (US)

(72) Inventor: David Ripple, Aberdeen, NJ (US)

( * ) Notice: Subject to any disclaimer, the term of this patent is extended or adjusted under 35 U.S.C. 154(b) by 96 days.

(21) Appl. No.: 16/414,935

(22) Filed: May 17, 2019

(65) Prior Publication Data

US 2020/0359760 A1 Nov. 19, 2020

(51) Int. Cl.
*A45C 11/20* (2006.01)
*A47G 23/02* (2006.01)

(52) U.S. Cl.
CPC ..... *A45C 11/20* (2013.01); *A47G 23/0241* (2013.01); *A47G 23/0266* (2013.01)

(58) Field of Classification Search
CPC . A45C 11/20; A47G 23/0241; A47G 23/0266
USPC ..... 220/23.4, 23.2, 23.83, 23.86, 737, 740, 220/741; 206/223
See application file for complete search history.

(56) References Cited

U.S. PATENT DOCUMENTS 5,137,210 A 8/1992 Hibbs
5,497,902 A * 3/1996 Crock ..... A47G 23/0216 220/23.4
5,624,052 A 4/1997 Caldi
6,533,233 B2 3/2003 Thomas
8,186,538 B2 5/2012 MacCarthy
D732,894 S 6/2015 Peterson
2004/0084458 A1 5/2004 Krueger
2006/0118453 A1 6/2006 Hillebrecht
2009/0090710 A1* 4/2009 Nielsen ..... B65D 69/00 220/23.4
2011/0220670 A1* 9/2011 Poole ..... B65D 81/3879 220/739
2012/0261410 A1* 10/2012 DuHaime ..... B65D 21/0206 220/23.83
2014/0203017 A1* 7/2014 Fowler ..... B65D 21/0204 220/23.83
2014/0346169 A1* 11/2014 Strominger ..... B65D 21/0209 220/23.83

* cited by examiner

*Primary Examiner* — Steven A. Reynolds

(57) ABSTRACT

A picnic food transportation assembly for transporting a beverage, condiments food items and eating utensils includes a canister for containing a canned beverage. A can is hingedly coupled to the canister to store packaged condiments. The can is positionable between an open and closed position for opening and closing the canister, and the can is removable from the canister. A lid is hingedly coupled to the can, and the lid is positionable between an open position and a closed position for opening and closing the can. A plurality of boxes is each of the boxes is removably coupled to the canister and each of the boxes can contain respective ones of eating utensils and food items. Each of the boxes is selectively coupled together when the boxes are not coupled to the canister.

8 Claims, 7 Drawing Sheets

PICNIC FOOD TRANSPORTATION ASSEMBLY

CROSS-REFERENCE TO RELATED APPLICATIONS

Statement Regarding Federally Sponsored Research or Development

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to food transportation device and more particularly pertains to a new food transportation device for transporting a beverage, condiments, eating utensils and food items.

(2) Description of Related Art Including Information Disclosed Under 37 CFR 1.97 and 1.98

The prior art relates to food transportation devices.

BRIEF SUMMARY OF THE INVENTION

An embodiment of the disclosure meets the needs presented above by generally comprising a canister for containing a canned beverage. A can is hingedly coupled to the canister to store packaged condiments. The can is positionable between an open and closed position for opening and closing the canister, and the can is removable from the canister. A lid is hingedly coupled to the can, and the lid is positionable between an open position and a closed position for opening and closing the can. A plurality of boxes is each of the boxes is removably coupled to the canister and each of the boxes can contain respective ones of eating utensils and food items. Each of the boxes is selectively coupled together when the boxes are not coupled to the canister.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
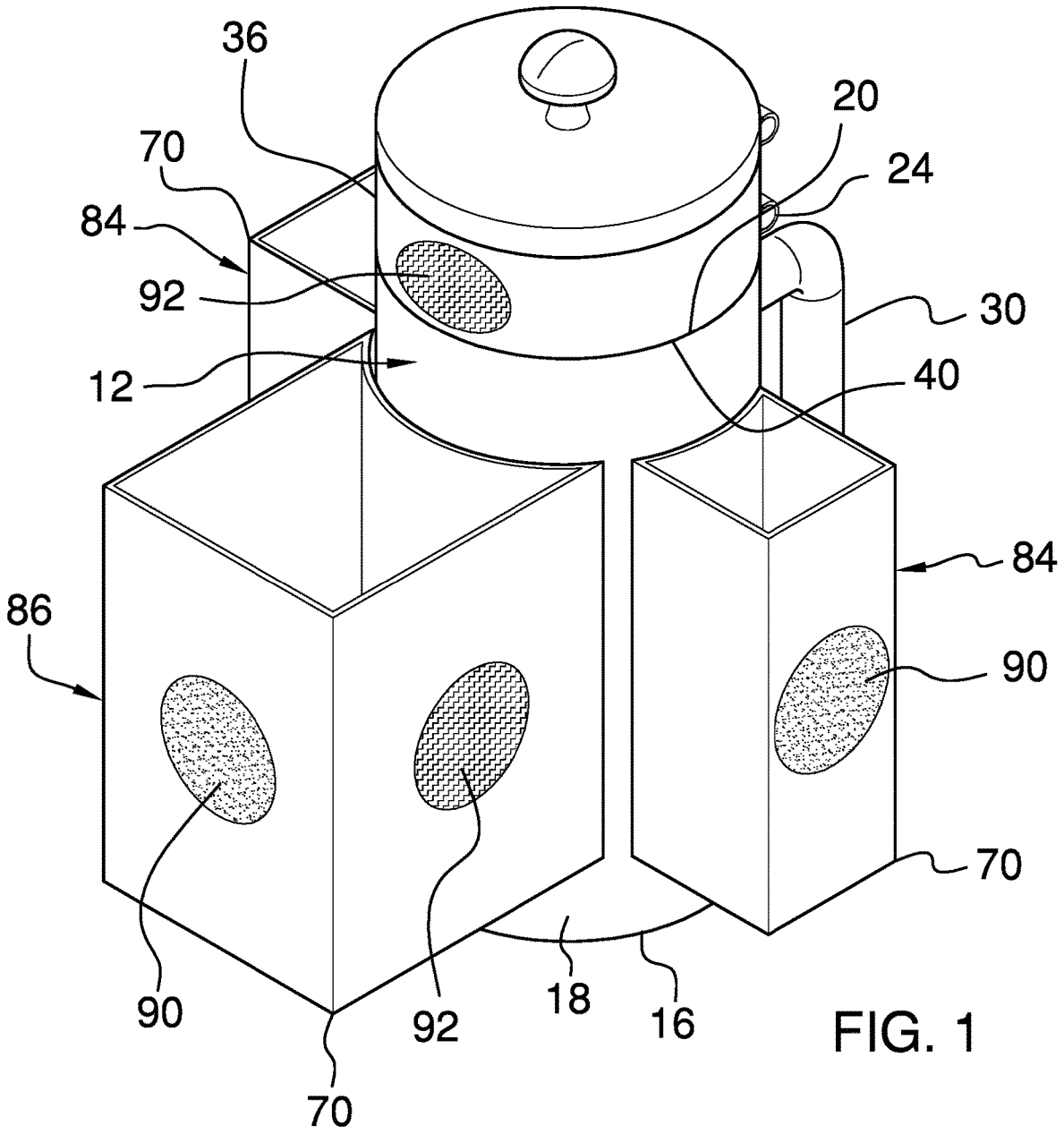
FIG. 1 is a top perspective view of a picnic food transportation assembly according to an embodiment of the disclosure.
Figure 2:
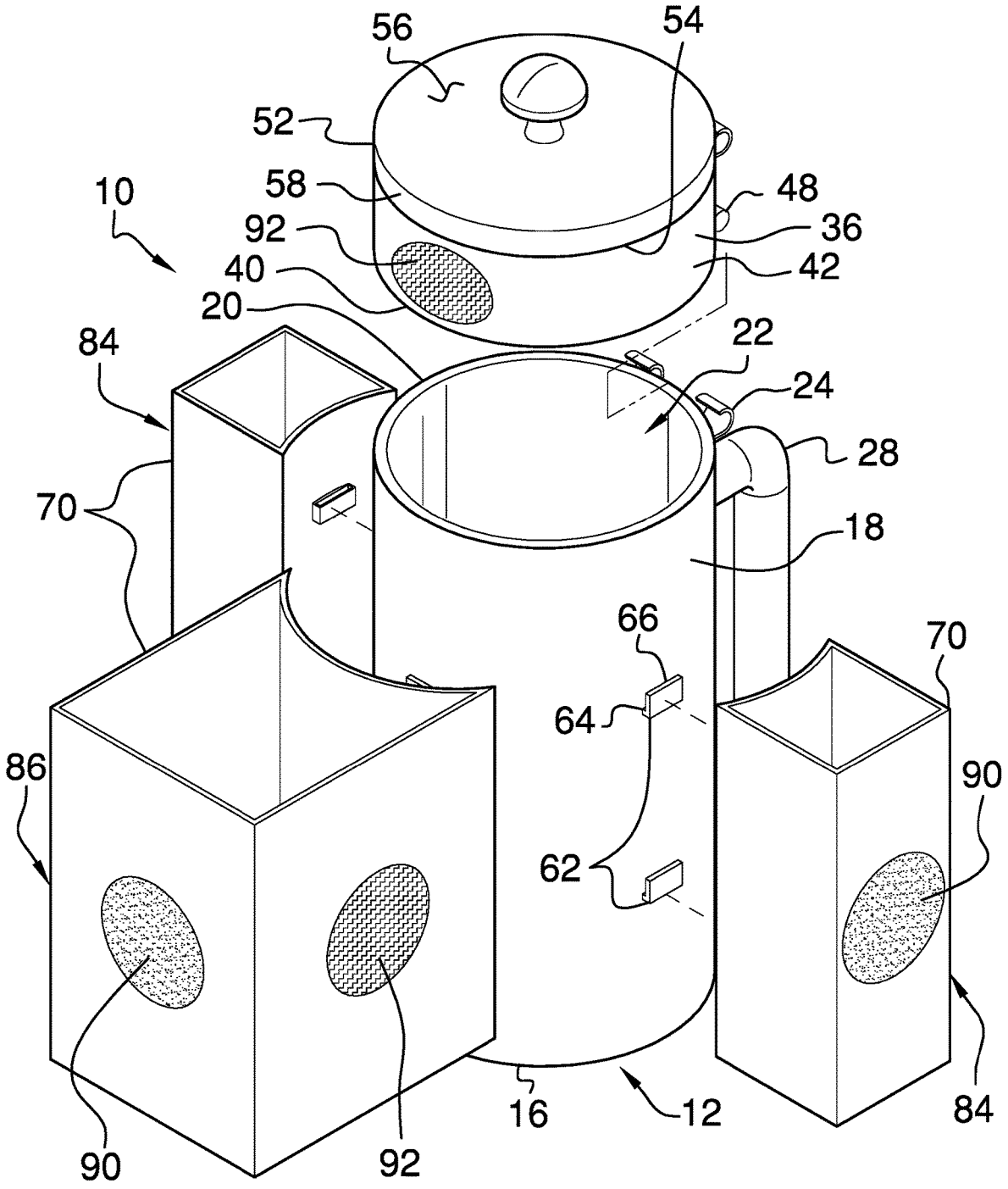
FIG. 2 is an exploded perspective view of an embodiment of the disclosure.
Figure 3:
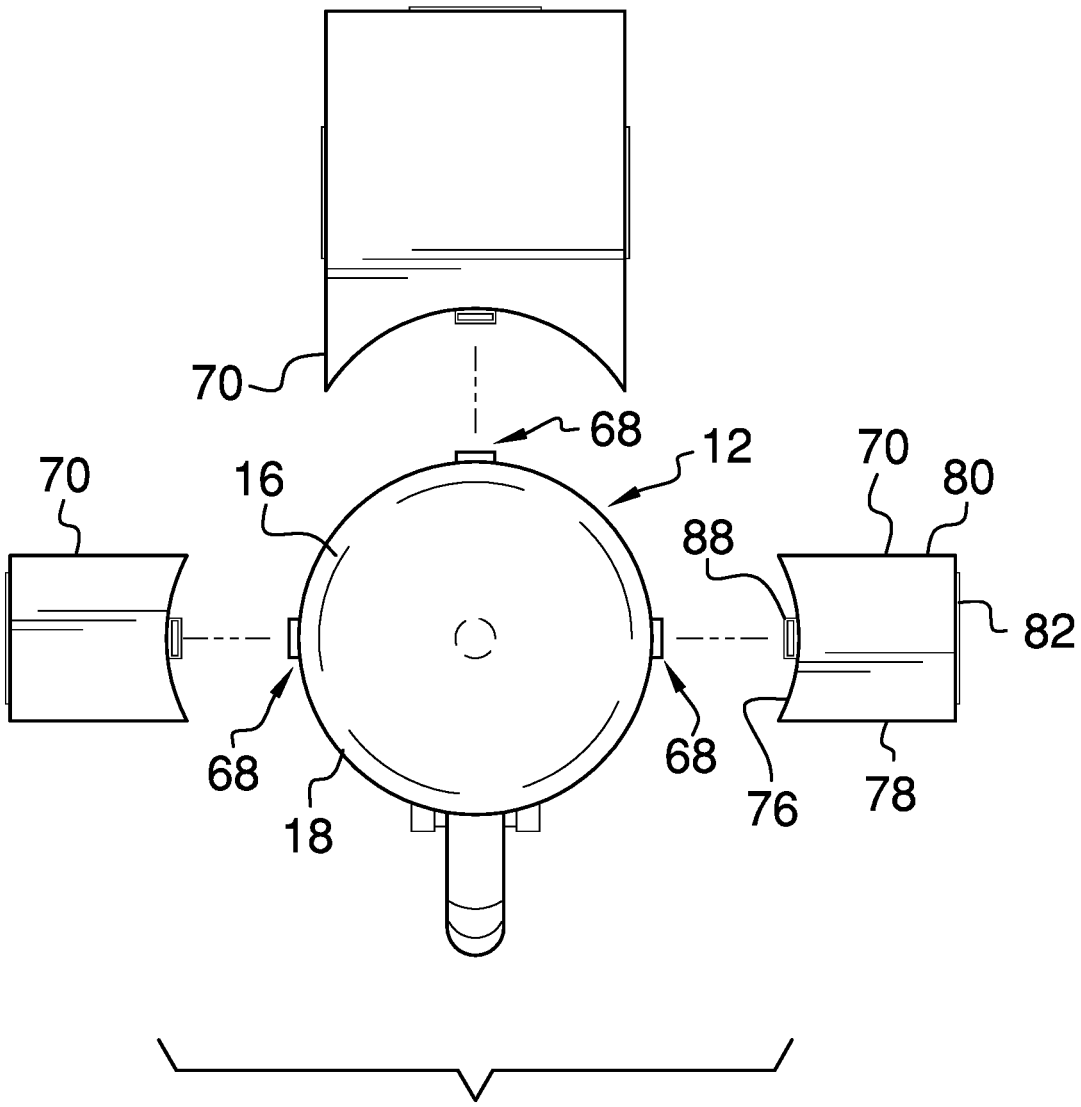
FIG. 3 is a bottom exploded view of an embodiment of the disclosure.
Figure 4:
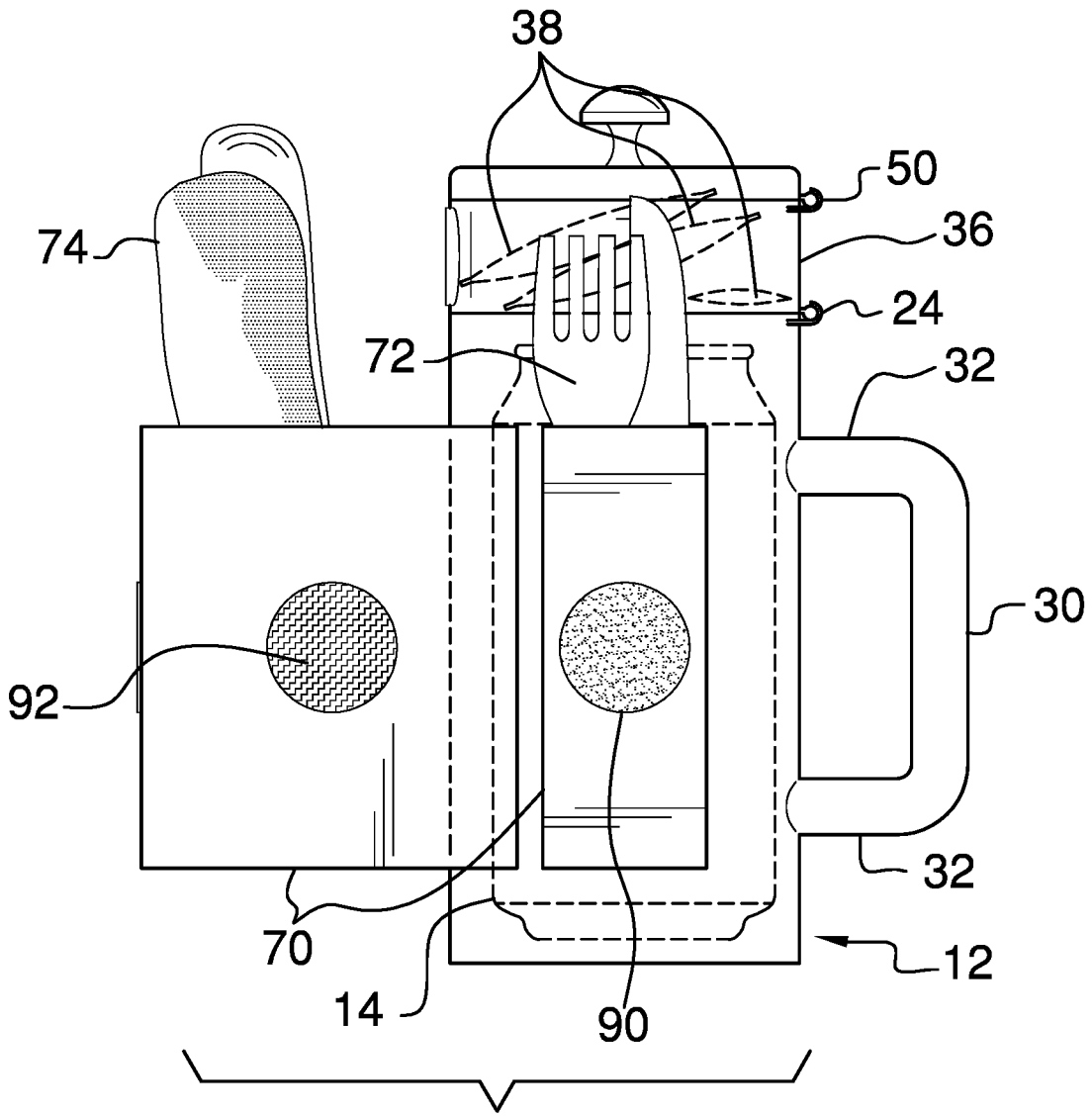
FIG. 4 is a left side phantom view of an embodiment of the disclosure.
Figure 5:
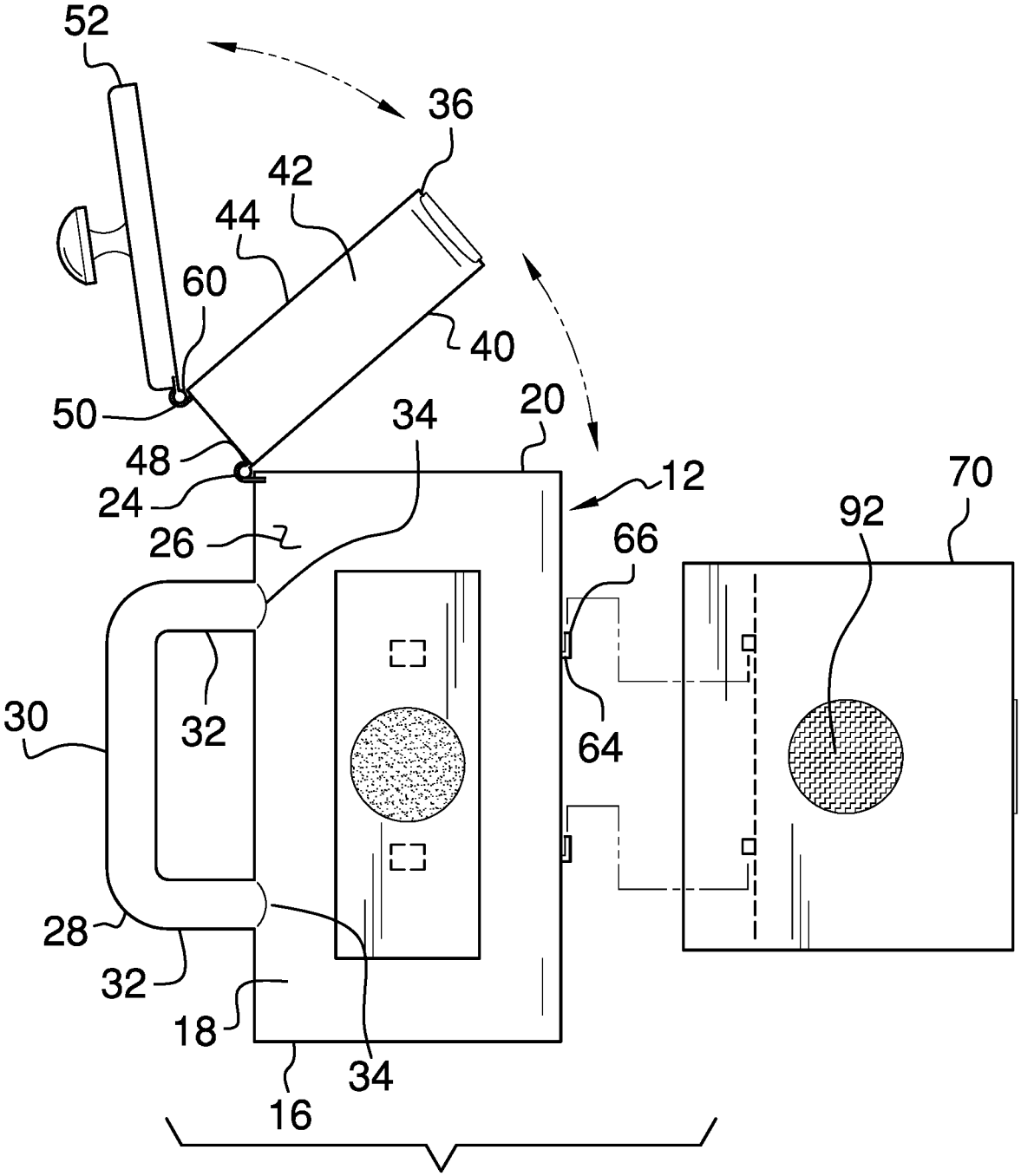
FIG. 5 is a right side exploded view of an embodiment of the disclosure.
Figure 6:
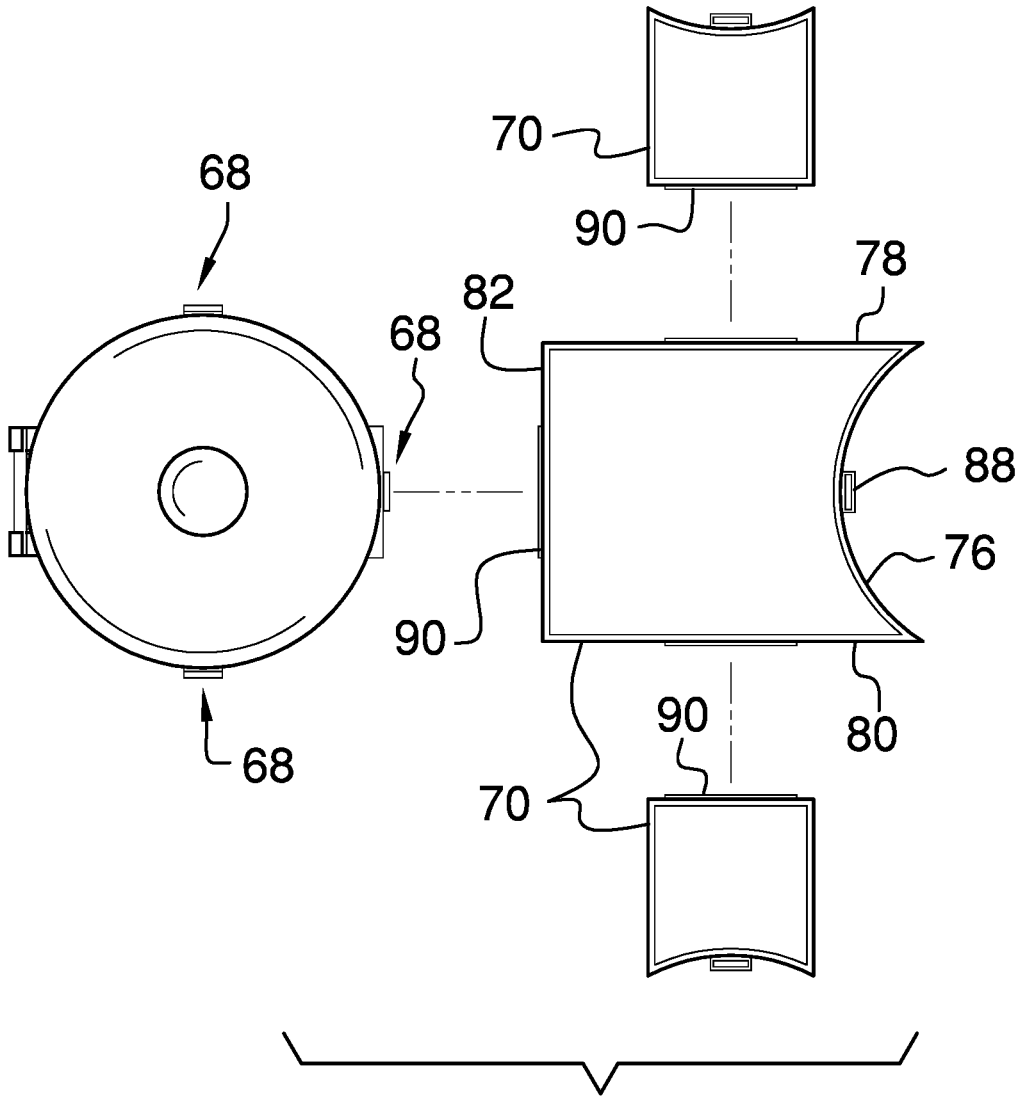
FIG. 6 is a top exploded view of an embodiment of the disclosure.
Figure 7:
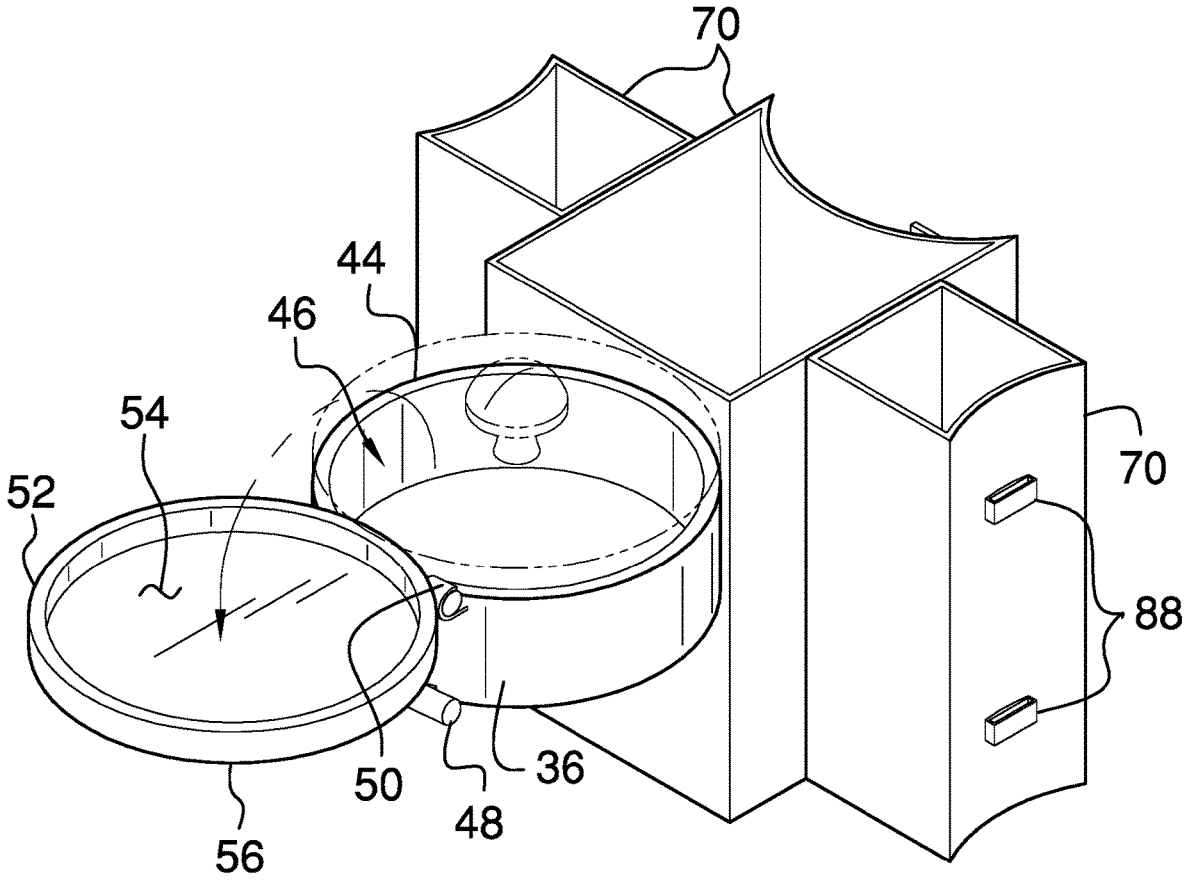
FIG. 7 is a perspective in-use view of an embodiment of the disclosure showing a plurality of boxes and a can being coupled together.

With reference now to the drawings, and in particular to FIGS. 1 through 7 thereof, a new food transportation device embodying the principles and concepts of an embodiment of the disclosure and generally designated by the reference numeral 10 will be described.

As best illustrated in FIGS. 1 through 7, the picnic food transportation assembly 10 generally comprises a canister 12 for containing a canned beverage 14, such as a can of soda or other similar canned beverage 14. Additionally, the canister 12 may contain a bottled beverage such as bottled water or the like. The canister 12 has a bottom wall 16 and an outer wall 18 extending upwardly therefrom, and the outer wall 18 has a distal edge 20 with respect to the bottom wall 16 defining an opening 22 into the canister 12. A first hinge 24 is coupled to an outer surface 26 of the outer wall 18 of the canister 12 and the first hinge 24 is aligned with the distal edge 20 of the outer wall 18 of the canister 12.

A handle 28 is coupled to the canister 12, and the handle 28 has a central member 30 extending between a pair of outward members 32. Each of the outward members 32 has a distal end 34 with respect to the central member 30. Additionally, the distal end 34 of each of the outward members 32 is coupled to the outer wall 18 of the canister 12 having the central member 30 being spaced from the outer wall 18 and being vertically oriented.

A can 36 is hingedly coupled to the canister 12 to store packaged condiments 38, such as single serving ketchup, mustard and other condiments 38. The can 36 is positionable between an open and closed position for opening and closing the canister 12, and the can 36 is removable from the canister 12. The can 36 has a lower wall 40 and an outside wall 42 extending upwardly therefrom, and the outside wall 42 has a distal edge 44 with respect to the lower wall 40 defining an opening 46 into the can 36. The lower wall 40 rests on the distal edge 20 of outer wall 18 of the canister 12 when the can 36 is positioned in the closed position. Additionally, the lower wall 40 is spaced from the distal edge 20 of the outer wall 18 of the canister 12 when the can 36 is positioned in the open position.

A first pin 48 is coupled to an outer surface 26 of the outside wall 42 of the can 36. The first pin 48 is aligned with the lower wall 40 of the can 36 and the first pin 48 is horizontally oriented on the outside wall 42. The first pin 48 rotatably engages the first hinge 24, and the first pin 48 is removable from the first hinge 24 for removing the can 36 from the canister 12. A second hinge 50 is coupled to an outer surface 26 of the outside wall 42 of the can 36, and the second hinge 50 is aligned with the distal edge 44 of the outside wall 42 of the can 36.

A lid 52 is hingedly coupled to the can 36, and the lid 52 is positionable between an open position and a closed position for opening and closing the can 36. The lid 52 has a lower surface 54, an upper surface 56 and an outer edge 58 extending therebetween. The lower surface 54 rests on the distal edge 44 of the outside wall 42 of the can 36 when the lid 52 is closed. A second pin 60 is coupled to the outer edge 58 of the lid 52 and the second pin 60 is aligned with the lower surface 54 of the lid 52. The second pin 60 is horizontally oriented on the outer edge 58 and the second pin 60 rotatably engages the second hinge 50.

A plurality of retainers 62 is each coupled to the outside wall 42 of the canister 12. Each of the retainers 62 comprises a leg 64 and a foot 66. The leg 64 of each of the retainers 62 is coupled to the outside wall 42 of the canister 12 having the foot 66 of each of the retainers 62 being spaced from the outside wall 42. Additionally, the foot 66 of each of the retainers 62 is directed upwardly. The retainers 62 are arranged on the outside wall 42 into a plurality of sets of the retainers 68. Each of the sets of retainers 68 are spaced apart from each other and are distributed around the outside wall 42.

A plurality of boxes 70 is provided and each of the boxes 70 is removably coupled to the canister 12. Each of the boxes 70 can contain respective ones of eating utensils 72 and food items 74. The food items 74 may be a hot dog or other type of food item commonly eaten outdoors or at a picnic. Each of the boxes 70 is selectively coupled together when the boxes 70 are not coupled to the canister 12. Each of the boxes 70 has a rear wall 76, a first lateral wall 78, a second lateral wall 80 and a front wall 82. The rear wall 76 of each of the boxes 70 is concavely arcuate with respect to the front wall 82 thereby facilitating the rear wall 76 of each of the boxes 70 to conform to the curvature of the outer wall 18 of the canister 12. The plurality of boxes 70 includes a pair of lateral boxes 84 and a front box 86, and the front box 86 has a perimeter that is greater than a perimeter of each of the lateral boxes 84.

A plurality of receivers 88 is each coupled to the rear wall 76 of a respective one of the boxes 70. Each of the receivers 88 insertably receives the foot 66 of a respective one of the retainers 62 on the canister 12 to releasably retain the respective box on the canister 12. A plurality of first mating members 90 is each coupled to a respective one of the lateral boxes 84. Each of the first mating members 90 is positioned on the front wall 82 of the respective lateral box 84. A plurality of second mating members 92 is each coupled to a respective one of the can 36 and the front box 86. Each of the first 90 and second 92 mating members may be respective ones of a hook and loop fastener or other similar releasable fastener.

The second mating member 92 on the can 36 is positioned on the outside wall 42 of the can 36. Each of the second mating members 92 on the front box 86 is positioned on a respective one of the first 78 and second 80 lateral walls of the front box 86. The first mating members 90 on each of the lateral boxes 84 releasably engage the second mating member 92 on a respective one of the first 78 and second 80 lateral walls when each of the front 86 and lateral 84 boxes are removed from the canister 12. Additionally, the second mating member 92 on the can 36 releasably engages the first mating member 90 on the front wall 82 of the front box 86 when the front box 86 and the can 36 are removed from the canister 12.

In use, the canned beverage 14 is positioned in the canister 12 and the can 36 is positioned in the closed position. The condiments 38 are positioned in the can 36 and the lid 52 is positioned in the closed position. The eating utensils 72 and the food items 74 are positioned in the respective boxes 70. Thus, the handle 28 on the canister 12 is gripped and the canned beverage 14, the condiments 38, the utensils 72 and the food items 74 can all be carried simultaneously to a picnic site or other eating area. The can 36 is positioned in the open position to remove the canned beverage 14 from the canister 12. Each of the boxes 70 is removed from the canister 12 and the boxes 70 are attached together with the first 90 and second 92 mating members. Additionally, the can 36 is removed from the canister 12 and the can 36 is coupled to the front box 86. In this way the condiments 38, the utensils 72 and the food item 74 are all positioned adjacent to each other and the canister 12 can be used as a drinking cup.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A picnic food transportation assembly being configured to store a canned beverage, condiments, utensils and food, said assembly comprising:

a canister being configured to contain a canned beverage, said canister has a bottom wall and an outer wall extending upwardly therefrom, said outer wall having a distal edge with respect to said bottom wall defining an opening into said canister;

a first hinge being coupled to an outer surface of said outer wall of said canister, said first hinge being aligned with said distal edge of said outer wall of said canister;

a handle being coupled to said canister, said handle having a central member extending between a pair of outward members, each of said outward members having a distal end with respect to said central member, said distal end of each of said outward members being coupled to said outer wall of said canister having said central member being spaced from said outer wall and being vertically oriented;

a can being hingedly coupled to said canister wherein said can is configured to store packaged condiments, said can being positionable between an open and closed position for opening and closing said canister, said can being removable from said canister, said can having a lower wall and an outside wall extending upwardly therefrom, said outside wall having a distal edge with respect to said lower wall defining an opening into said can, said lower wall resting on said distal edge of outer wall of said canister when said can is positioned in said closed position, said lower wall being spaced from said distal edge of said outer wall of said canister when said can is positioned in said open position;

a first pin being coupled to an outer surface of said outside wall of said can, said first pin being aligned with said lower wall of said can, said first pin being horizontally oriented on said outside wall, said first pin rotatably engaging said first hinge, said first pin being removable from said first hinge for removing said can from said canister;

a lid being hingedly coupled to said can, said lid being positionable between an open position and a closed position for opening and closing said can; and a plurality of boxes, each of said boxes being removably coupled to said canister wherein each of said boxes is configured to contain respective ones of eating utensils and food items, each of said boxes being selectively coupled together when said boxes are not coupled to said canister.

2. The assembly according to claim 1, wherein:

said lid has a lower surface, an upper surface and an outer edge extending therebetween, said lower surface resting on said distal edge of said outside wall of said can;

said assembly includes a second hinge being coupled to said an outer surface of said outside wall of said can, said second hinge being aligned with said distal edge of said outside wall of said can; and said assembly includes a second pin being coupled to said outer edge of said lid, said second pin being aligned with said lower surface of said lid, said second pin being horizontally oriented on said outer edge, said second pin rotatably engaging said second hinge.

3. The assembly according to claim 1, further comprising a plurality of retainers, each of said retainers being coupled to said outer wall of said canister, each of said retainers comprising a leg and a foot, said leg of each of said retainers being coupled to said outer wall of said canister having said foot of each of said retainers being spaced from said outer wall, said foot of each of said retainers being directed upwardly, said retainers being arranged on said outer wall into a plurality of sets of said retainers, each of said sets of retainers being vertically distributed on said outer wall, said sets of retainers being spaced apart from each other and being distributed around said outer wall.

4. The assembly according to claim 3, wherein each of said boxes has a rear wall, a first lateral wall, a second lateral wall and a front wall, said rear wall of each of said boxes being concavely arcuate with respect to said front wall thereby facilitating said rear wall of each of said boxes to conform to the curvature of said outer wall of said canister, said plurality of boxes including a pair of lateral boxes and a front box, said front box having a perimeter being greater than a perimeter of each of said lateral boxes.

5. The assembly according to claim 4, further comprising a plurality of receivers, each of said receivers being coupled to said rear wall of a respective one of said boxes, each of said receivers insertably receiving said foot of a respective one of said retainers on said canister to releasably retain said respective box on said canister.

6. The assembly according to claim 4, further comprising a plurality of first mating members, each of said first mating members being coupled to a respective one of said lateral boxes, each of said first mating members being positioned on said front wall of said respective lateral box.

7. The assembly according to claim 6, further comprising a plurality of second mating members, each of said second mating members being coupled to a respective one of said can and said front box, said second mating member on said can being positioned on said outside wall of said can, each of said second mating members on said front box being positioned on a respective one of said first and second lateral walls of said front box, said first mating members on each of said lateral boxes releasably engaging said second mating member on a respective one of said first and second lateral walls when each of said front and lateral boxes are removed from said canister, said second mating member on said can releasably engaging said first mating member on said front wall of said front box when said front box and said can are removed from said canister.

8. A picnic food transportation assembly being configured to store a canned beverage, condiments, utensils and food, said assembly comprising:

a canister being configured to contain a canned beverage, said canister having a bottom wall and an outer wall extending upwardly therefrom, said outer wall having a distal edge with respect to said bottom wall defining an opening into said canister;

a first hinge being coupled to an outer surface of said outer wall of said canister, said first hinge being aligned with said distal edge of said outer wall of said canister;

a handle being coupled to said canister, said handle having a central member extending between a pair of outward members, each of said outward members having a distal end with respect to said central member, said distal end of each of said outward members being coupled to said outer wall of said canister having said central member being spaced from said outer wall and being vertically oriented;

a can being hingedly coupled to said canister wherein said can is configured to store packaged condiments, said can being positionable between an open and closed position for opening and closing said canister, said can being removable from said canister, said can having a lower wall and an outside wall extending upwardly therefrom, said outside wall having a distal edge with respect to said lower wall defining an opening into said can, said lower wall resting on said distal edge of outer wall of said canister when said can is positioned in said closed position, said lower wall being spaced from said distal edge of said outer wall of said canister when said can is positioned in said open position;

a first pin being coupled to an outer surface of said outside wall of said can, said first pin being aligned with said lower wall of said can, said first pin being horizontally oriented on said outside wall, said first pin rotatably engaging said first hinge, said first pin being removable from said first hinge for removing said can from said canister;

a second hinge being coupled to said an outer surface of said outside wall of said can, said second hinge being aligned with said distal edge of said outside wall of said can;

a lid being hingedly coupled to said can, said lid being positionable between an open position and a closed position for opening and closing said can, said lid having a lower surface, an upper surface and an outer edge extending therebetween, said lower surface resting on said distal edge of said outside wall of said can;

a second pin being coupled to said outer edge of said lid, said second pin being aligned with said lower surface of said lid, said second pin being horizontally oriented on said outer edge, said second pin rotatably engaging said second hinge;

a plurality of retainers, each of said retainers being coupled to said outside wall of said canister, each of said retainers comprising a leg and a foot, said leg of each of said retainers being coupled to said outside wall of said canister having said foot of each of said retainers being spaced from said outside wall, said foot of each of said retainers being directed upwardly, said retainers being arranged on said outside wall into a plurality of sets of said retainers, each of said sets of retainers being vertically distributed on said outside wall, said sets of retainers being spaced apart from each other and being distributed around said outside wall;

a plurality of boxes, each of said boxes being removably coupled to said canister wherein each of said boxes is configured to contain respective ones of eating utensils and food items, each of said boxes being selectively coupled together when said boxes are not coupled to said canister, each of said boxes having a rear wall, a first lateral wall, a second lateral wall and a front wall, said rear wall of each of said boxes being concavely arcuate with respect to said front wall thereby facilitating said rear wall of each of said boxes to conform to the curvature of said outer wall of said canister, said plurality of boxes including a pair of lateral boxes and a front box, said front box having a perimeter being greater than a perimeter of each of said lateral boxes;

a plurality of receivers, each of said receivers being coupled to said rear wall of a respective one of said boxes, each of said receivers insertably receiving said foot of a respective one of said retainers on said canister to releasably retain said respective box on said canister;

a plurality of first mating members, each of said first mating members being coupled to a respective one of said lateral boxes, each of said first mating members being positioned on said front wall of said respective lateral box; and a plurality of second mating members, each of said second mating members being coupled to a respective one of said can and said front box, said second mating member on said can being positioned on said outside wall of said can, each of said second mating members on said front box being positioned on a respective one of said first and second lateral walls of said front box, said first mating members on each of said lateral boxes releasably engaging said second mating member on a respective one of said first and second lateral walls when each of said front and lateral boxes are removed from said canister, said second mating member on said can releasably engaging said first mating member on said front wall of said front box when said front box and said can are removed from said canister.

* * * * *